US010765196B1

(12) United States Patent
Thompson

(10) Patent No.: US 10,765,196 B1
(45) Date of Patent: Sep. 8, 2020

(54) GEAR ATTACHMENT SYSTEM

(71) Applicant: Charles Kevin Thompson, Austin, TX (US)

(72) Inventor: Charles Kevin Thompson, Austin, TX (US)

( * ) Notice: Subject to any disclaimer, the term of this patent is extended or adjusted under 35 U.S.C. 154(b) by 0 days.

(21) Appl. No.: 16/425,639

(22) Filed: May 29, 2019

Related U.S. Application Data

(60) Provisional application No. 62/678,840, filed on May 31, 2018.

(51) Int. Cl.
*A45F 5/00* (2006.01)
*A45F 5/02* (2006.01)

(52) U.S. Cl.
CPC ..... *A45F 5/02* (2013.01); *A45F 2005/023* (2013.01)

(58) Field of Classification Search
CPC ..... A45F 5/02; A45F 2005/023
USPC ..... 224/413
See application file for complete search history.

(56) References Cited

U.S. PATENT DOCUMENTS 6,533,340 B1 * 3/2003 Gaunzon ..... B60R 7/02 224/268
6,712,567 B2 * 3/2004 Hsu ..... B60P 7/0815 410/35
9,797,679 B2 * 10/2017 Ponder ..... F41C 33/001
2004/0145206 A1 * 7/2004 Hicks ..... B60R 7/02 296/37.16
2009/0014602 A1 * 1/2009 Frost ..... B60R 7/08 248/100
2011/0259772 A1 * 10/2011 Forsyth ..... H01L 21/67373 206/320
2012/0175391 A1 * 7/2012 Rogers ..... F41C 33/045 224/182
2013/0181019 A1 * 7/2013 Salentine ..... A45F 5/021 224/242
2015/0377585 A1 * 12/2015 Fowler ..... F41C 33/045 224/271

* cited by examiner

*Primary Examiner* — Peter N Helvey
(74) *Attorney, Agent, or Firm* — Plager Schack LLP; Mark H. Plager; Michael J. O'Brien

(57) ABSTRACT

A storage system is configured to store material on a mountable surface. The storage system includes a mounting panel with a pouch attachment ladder system grid of webbing slots, a plurality of rigid stay protrusion slots and a plurality of mounting hardware holes. A modular lightweight load-carrying equipment holster that has a pouch attachment ladder system grid of webbing. The pouch attachment ladder system grid of webbing fits through the pouch attachment ladder system grid of webbing slots which is then held in place with a rigid stay. The rigid stay further comprises a protrusion in order to prevent the rigid stay from sliding out of the pouch attachment ladder system grid of webbing.

4 Claims, 5 Drawing Sheets

GEAR ATTACHMENT SYSTEM

RELATED APPLICATION

This application claims priority to provisional patent application U.S. Ser. No. 62/678,840 filed on May 31, 2018, the entire contents of which is herein incorporated by reference.

BACKGROUND

The embodiments herein relate generally to systems for organizing and attaching gear in a storage compartment.

Prior to embodiments of the disclosed invention organizing items in small storage compartments (like those found on motorcycles) was difficult because many storage compartments do not have separate sections configured to meet the user's specific personal needs. Embodiments of the disclosed invention solve this problem.

SUMMARY

A storage system is configured to store material on a mountable surface. The storage system includes a mounting panel with a pouch attachment ladder system grid of webbing slots, a plurality of rigid stay protrusion slots and a plurality of mounting hardware holes. A modular lightweight load-carrying equipment holster that has a pouch attachment ladder system grid of webbing. The pouch attachment ladder system grid of webbing fits through the pouch attachment ladder system grid of webbing slots which is then held in place with a rigid stay. The rigid stay further comprises a protrusion in order to prevent the rigid stay from sliding out of the pouch attachment ladder system grid of webbing.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
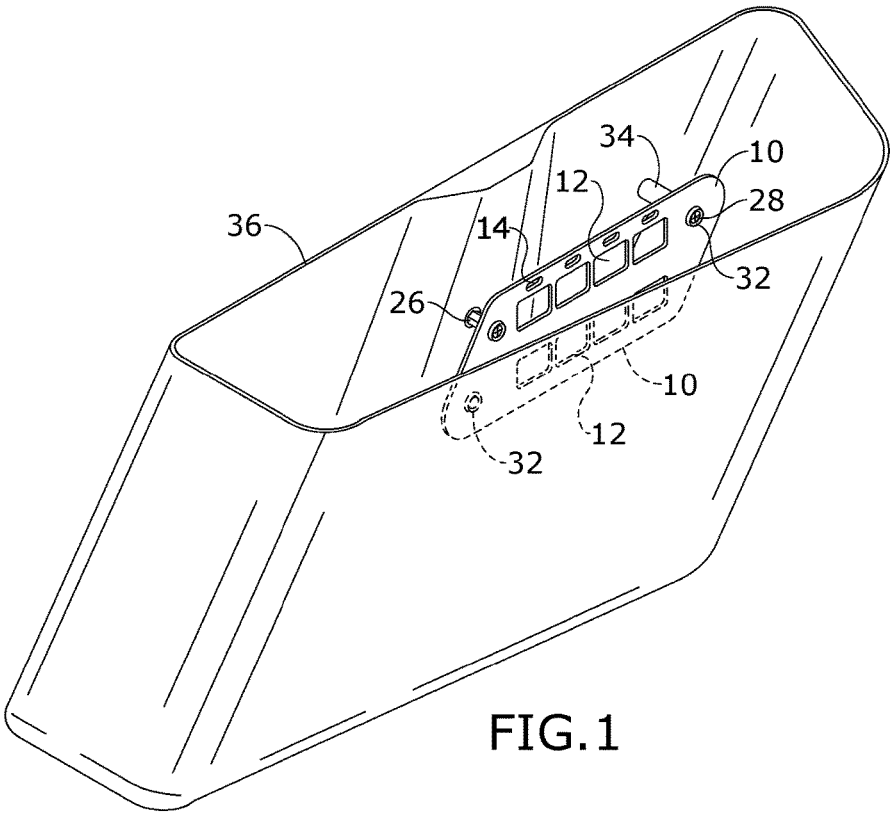
FIG. 1 shows a front perspective view of an embodiment of the invention.
Figure 2:
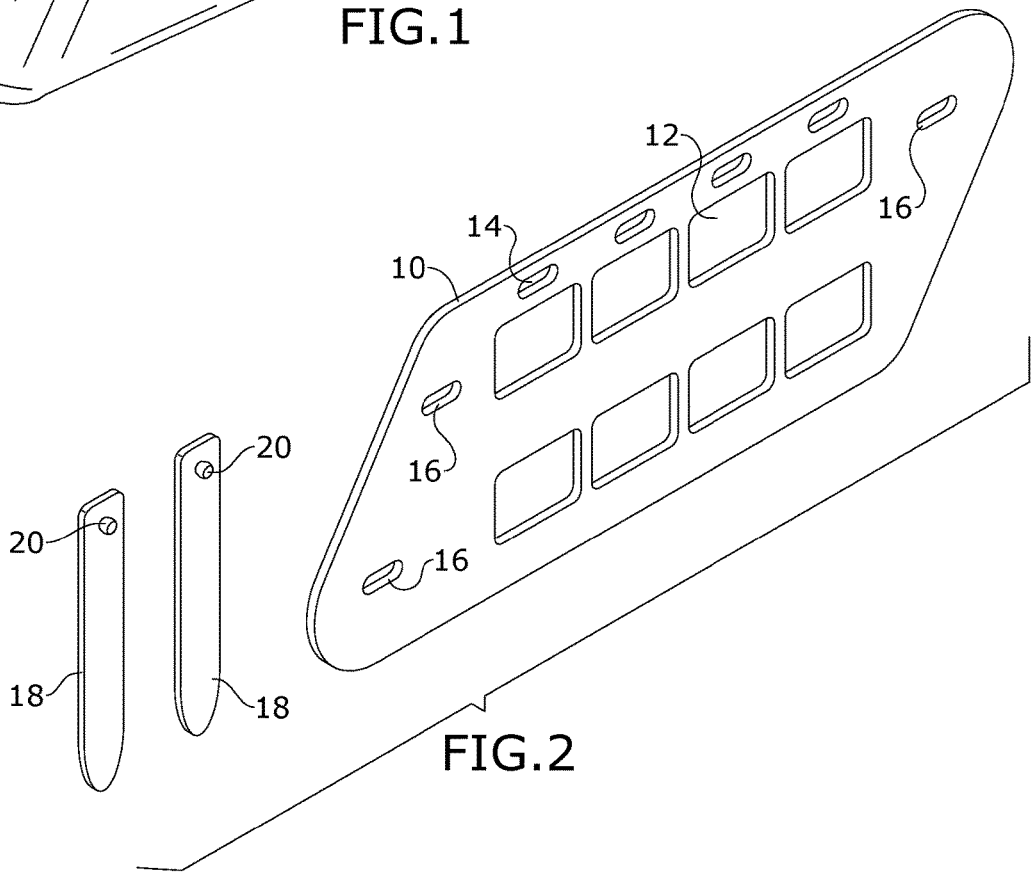
FIG. 2 shows a perspective view of an embodiment of the invention.
Figure 3:
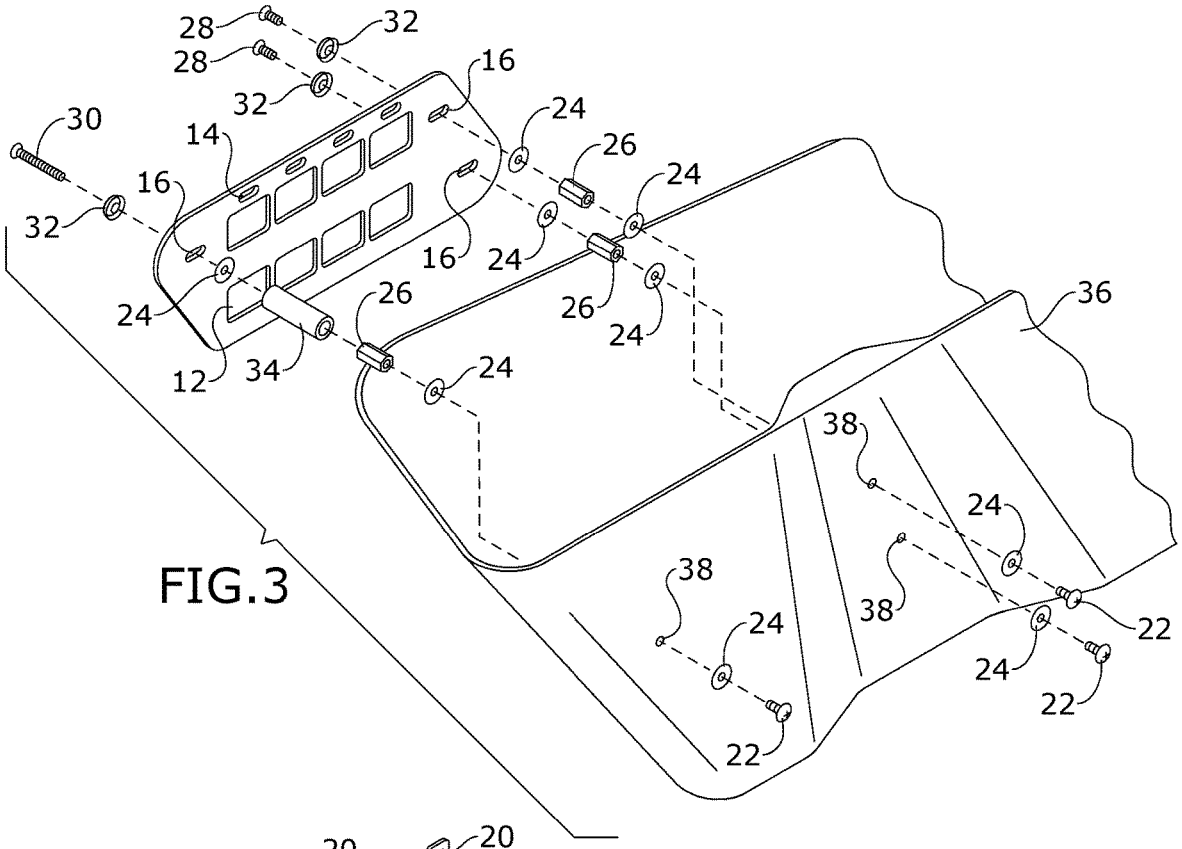
FIG. 3 shows a rear perspective view of an embodiment of the invention.
Figure 4:
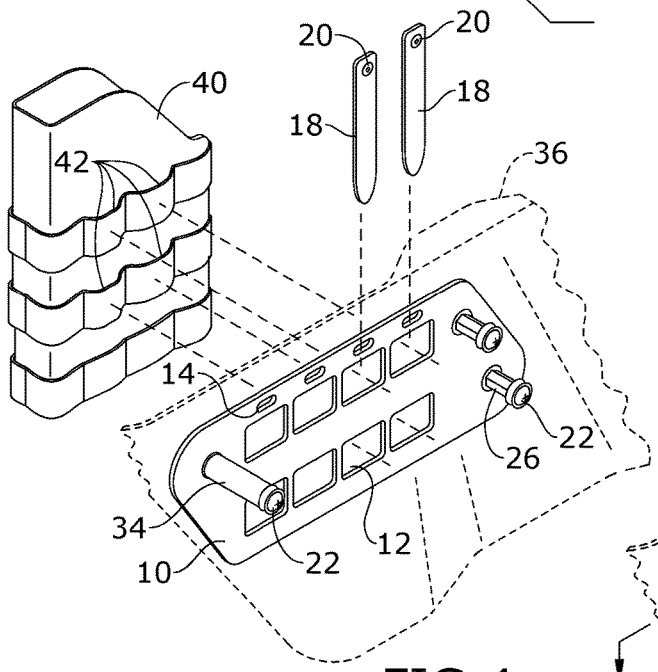
FIG. 4 shows a rear perspective view of an embodiment of the invention.
Figure 5:
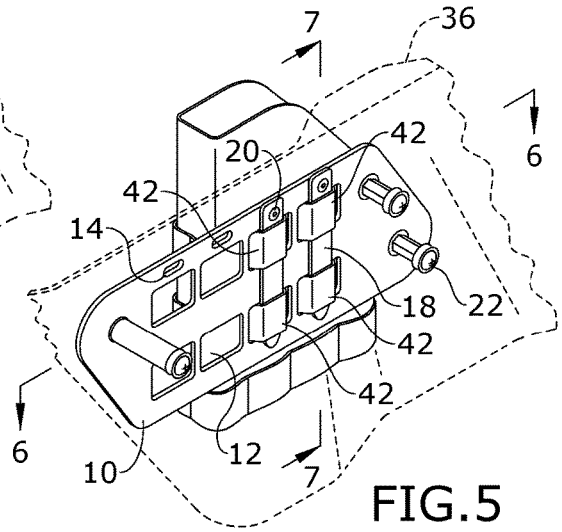
FIG. 5 shows a front perspective view of an embodiment of the invention.

By way of example, and referring to FIGS. 1-8, a storage system for a saddlebag 36 further comprises a two row mounting panel 10. The two row mounting panel 10 further comprises a pouch attachment ladder system grid of webbing slots 12, a plurality of rigid stay protrusion slots 14 and a plurality of mounting hardware holes 16.

A rigid stay 18 further comprises a protrusion 20. A modular lightweight load-carrying equipment holster 40 further comprise a pouch attachment ladder system grid of webbing 42. The pouch attachment ladder system grid of webbing 42 fits through the pouch attachment ladder system grid of webbing slots 12 which is then held in place with a rigid stay 18.

Figure 6:
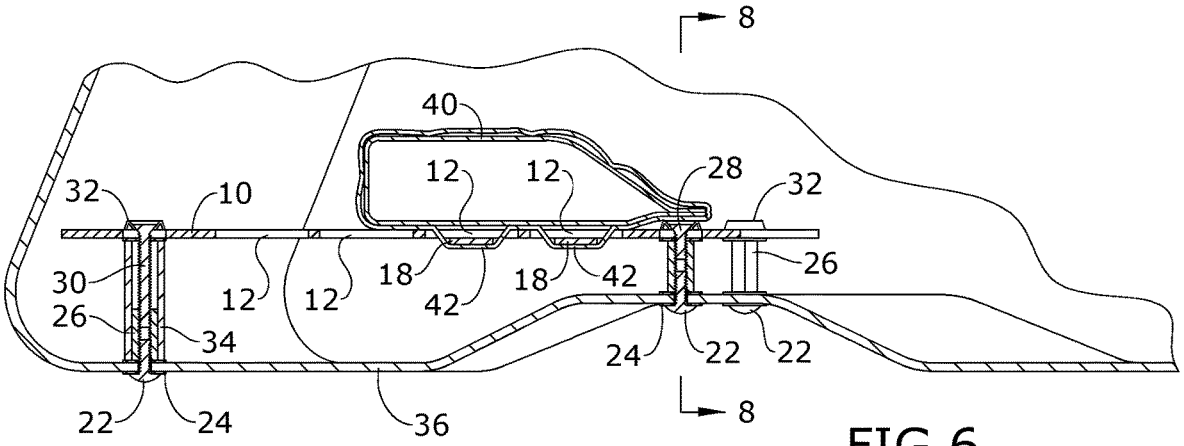
FIG. 6 shows a section view of an embodiment of the invention taken along line 6-6 in FIG. 5.
Figure 7:
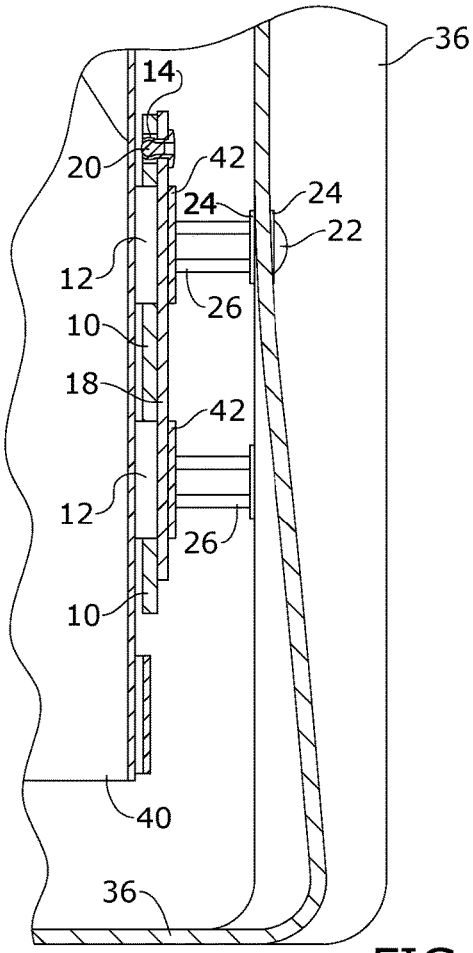
FIG. 7 shows a section view of an embodiment of the invention taken along line 7-7 in FIG. 5.
Figure 8:
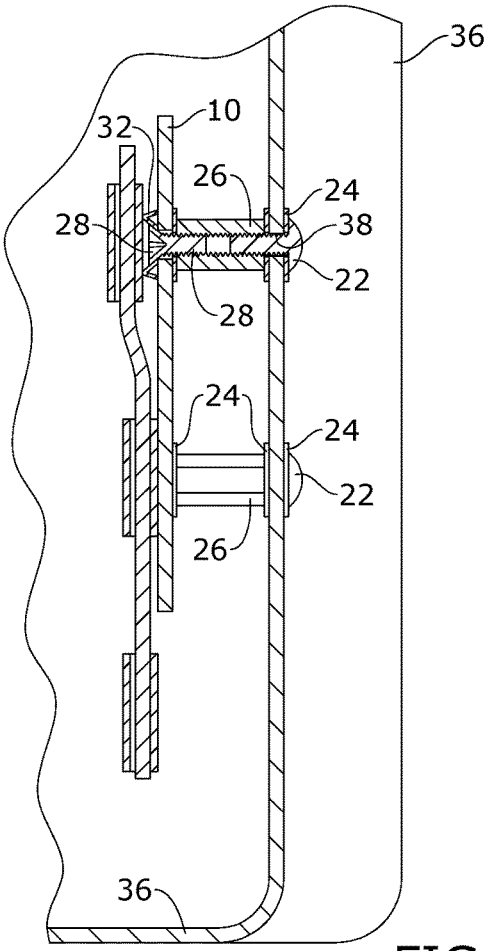
FIG. 8 shows a section view of an embodiment of the invention taken along line 8-8 in FIG. 6.

A rear mounting screw 22 is inserted through a drilled saddlebag mounting hole 38 in the saddlebag 36 with a washer 24 on either side of a saddlebag wall. The rear mounting screw 22 is joined to a coupling nut 26. The coupling nut 26 is connected to a mounting hardware hole 16 with a short front mounting screw 28, a washer 24 and a trim washer 32. Alternately, the rear mounting screw 22 is joined to a spacer sleeve 34. The spacer sleeve 34 is connected to a mounting hardware hole 16 with a long front mounting screw 30, a washer 24 and a trim washer 32. FIGS. 6-8 show various configurations of the different length screws and when they are used depending on the size and orientation of saddlebag 36.

Figure 9:
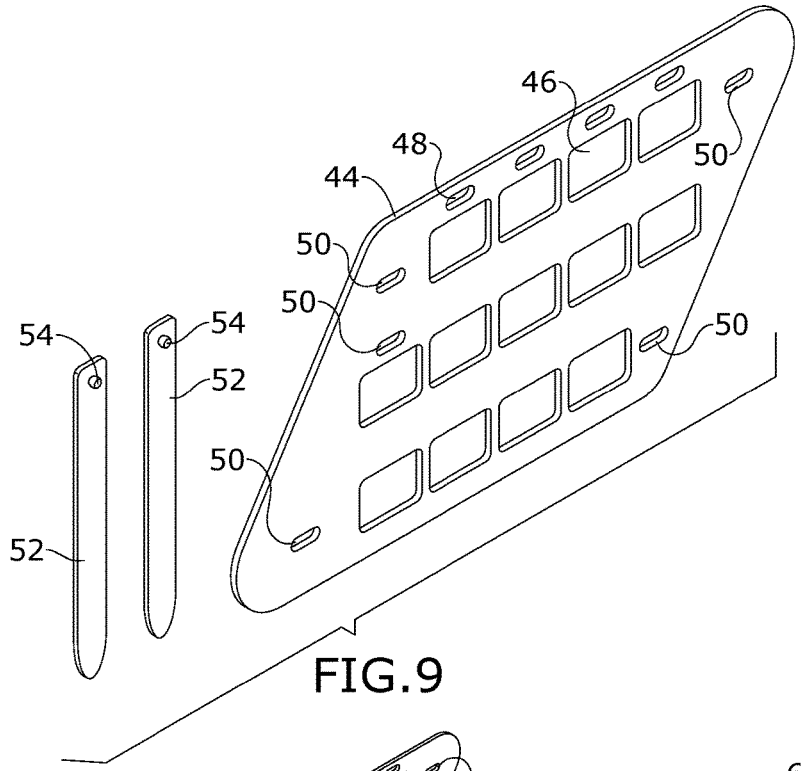
FIG. 9 shows a perspective view of an embodiment of the invention.

Referring to FIG. 9, a storage system for a saddlebag 36 further comprises a three row mounting panel 44. The three row mounting panel 44 further comprises a pouch attachment ladder system grid of webbing slots 46, a plurality of rigid stay protrusion slots 48 and a plurality of mounting hardware holes 50.

A rigid stay 52 further comprises a protrusion 54. The pouch attachment ladder system grid of webbing 42 fits through the pouch attachment ladder system grid of webbing slots 46 which is then held in place with a rigid stay 52.

Figure 10:
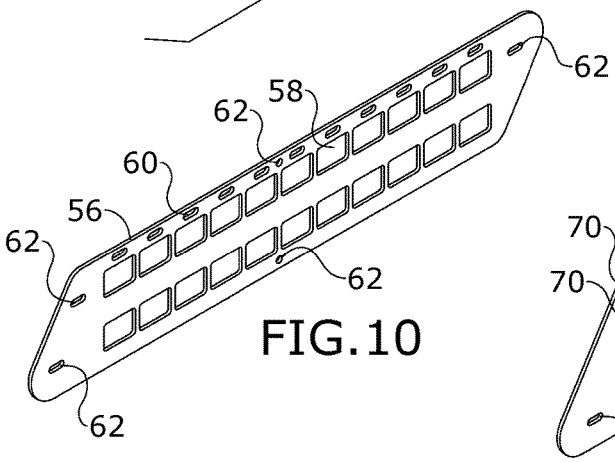
FIG. 10 shows a perspective view of an embodiment of the invention.

Referring to FIG. 10, a storage system for a saddlebag 36 further comprises a large saddlebag two row mounting panel 56. The large saddlebag two row mounting panel 56 further comprises a pouch attachment ladder system grid of webbing slots 58, a plurality of rigid stay protrusion slots 60 and a plurality of mounting hardware holes 62.

Figure 11:
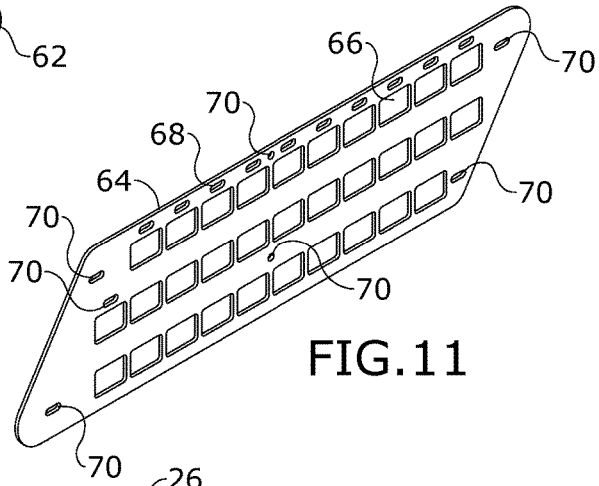
FIG. 11 shows a perspective view of an embodiment of the invention.

Referring to FIG. 11, a storage system for a saddlebag 36 further comprises a large saddlebag three row mounting panel 64. The large saddlebag two row mounting panel 64 further comprises a pouch attachment ladder system grid of webbing slots 66, a plurality of rigid stay protrusion slots 68 and a plurality of mounting hardware holes 70.

Figure 12:
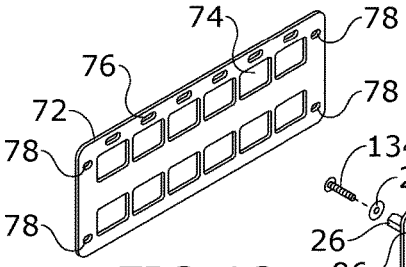
FIG. 12 shows a perspective view of an embodiment of the invention.

Referring to FIG. 12, a storage system for a saddlebag 36 further comprises a universal two row mounting panel 72. The universal two row mounting panel 72 further comprises a pouch attachment ladder system grid of webbing slots 74, a plurality of rigid stay protrusion slots 76 and a plurality of mounting hardware holes 78.

Figure 13:
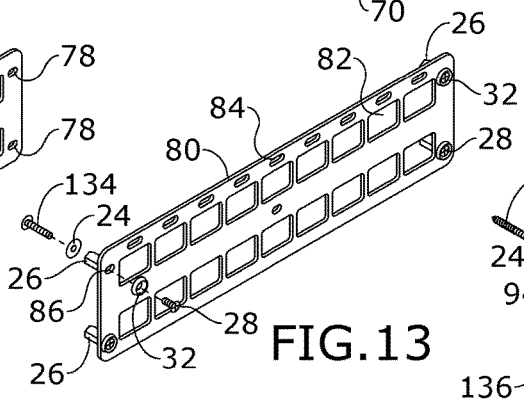
FIG. 13 shows a perspective view of an embodiment of the invention.

Referring to FIG. 13, a storage system for a saddlebag 36 further comprises a universal two row wide mounting panel 80. The universal two row wide mounting panel 80 further comprises a pouch attachment ladder system grid of webbing slots 82, a plurality of rigid stay protrusion slots 84 and a plurality of mounting hardware holes 86. A surface mounting screw 134 can be inserted through one of the rigid stay protrusion slots 84.

Figure 14:
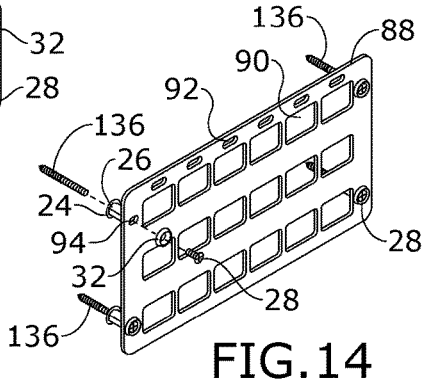
FIG. 14 shows a perspective view of an embodiment of the invention.

Referring to FIG. 14, a storage system for a saddlebag 36 further comprises a universal three row mounting panel 88. The universal three row mounting panel 88 further comprises a pouch attachment ladder system grid of webbing slots 90, a plurality of rigid stay protrusion slots 92 and a plurality of mounting hardware holes 94. A hanger bolt 136 can be used to mount the universal three row mounting panel 88.

Figure 15:
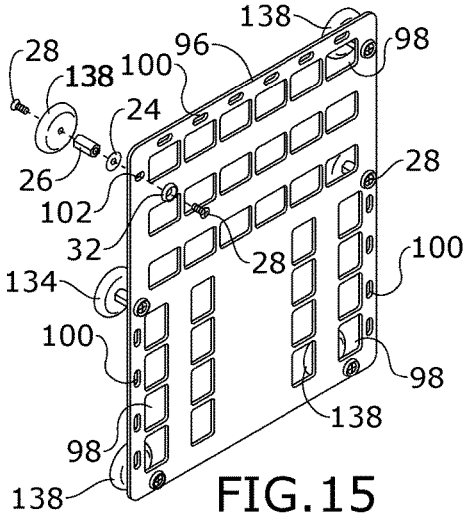
FIG. 15 shows a perspective view of an embodiment of the invention.

Referring to FIG. 15, a storage system for a wall or magnet mount further comprises a universal wide mounting panel 96. The universal wide mounting panel 96 further comprises a pouch attachment ladder system grid of webbing slots 98, a plurality of rigid stay protrusion slots 100 and a plurality of mounting hardware holes 102. To join the universal wide mounting panel 96 to a metallic surface with a magnetic foot 138 can be used.

Figure 16:
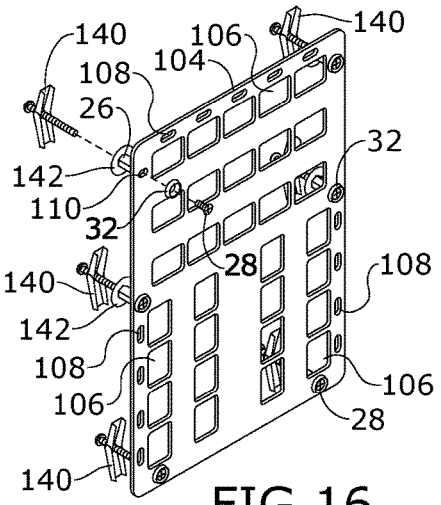
FIG. 16 shows a perspective view of an embodiment of the invention.

Referring to FIG. 16, a storage system for a wall or magnet mount further comprises a universal mounting panel 104. The universal wide mounting panel 104 further comprises a pouch attachment ladder system grid of webbing slots 106, a plurality of rigid stay protrusion slots 108 and a plurality of mounting hardware holes 110. A toggle mount 140 can be used with a large washer to join the universal mounting panel 104 to a wall.

Figure 17:
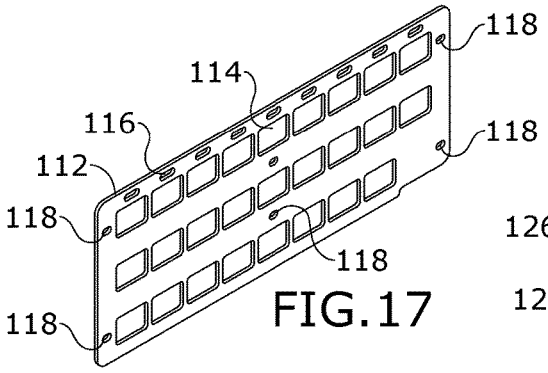
FIG. 17 shows a perspective view of an embodiment of the invention.
Figure 18:
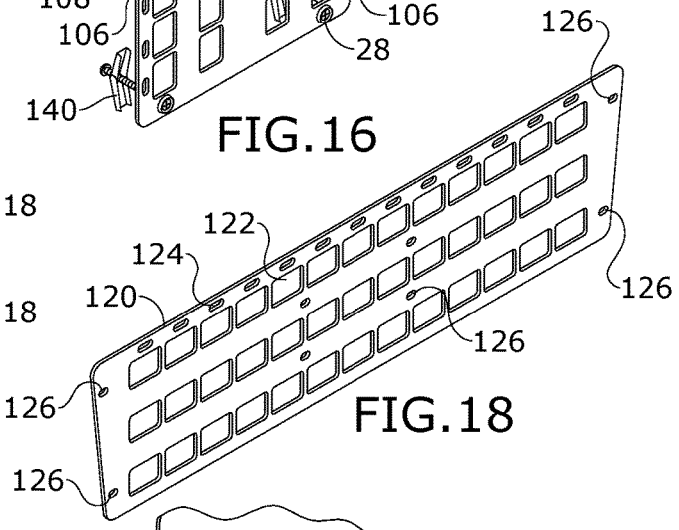
FIG. 18 shows a perspective view of an embodiment of the invention.
Figure 19:
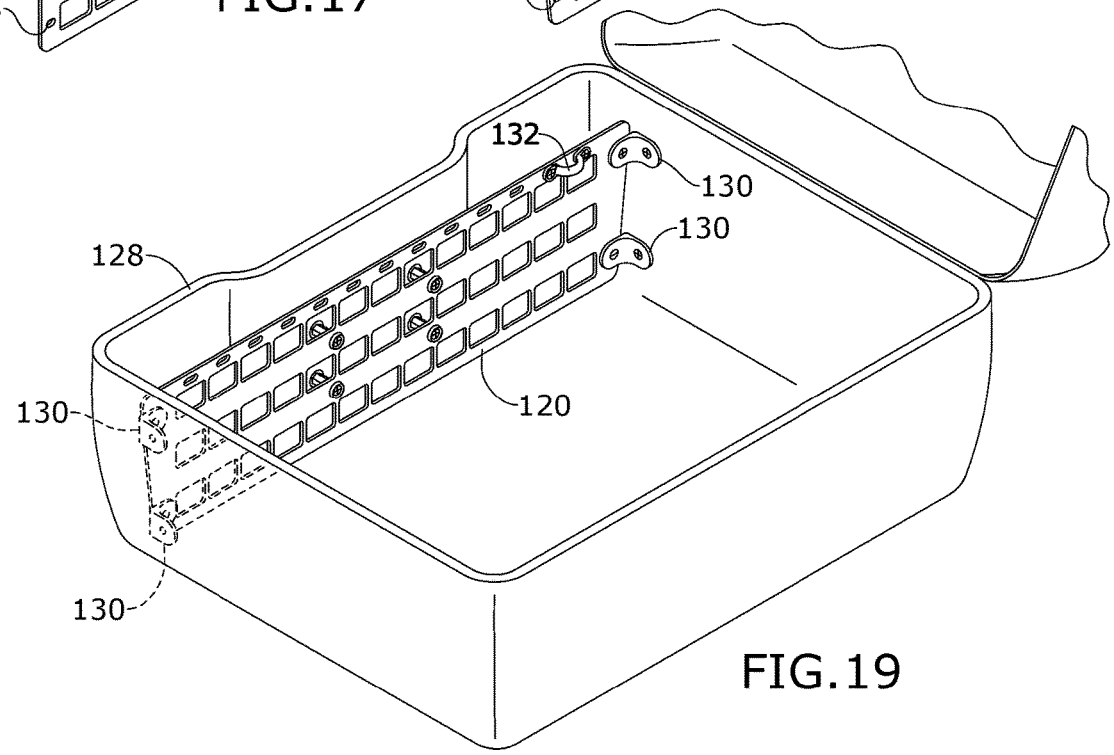
FIG. 19 shows a perspective view of an embodiment of the invention.

Referring to FIGS. 17-19, a storage system for a luggage carrier 128 further comprises a luggage carrier mounting panel 112. The luggage carrier mounting panel 112 further comprises a pouch attachment ladder system grid of webbing slots 114, a plurality of rigid stay protrusion slots 116 and a plurality of mounting hardware holes 118.

A storage system for a luggage carrier 128 further comprises a wide luggage carrier mounting panel 120. The wide luggage carrier mounting panel 120 further comprises a pouch attachment ladder system grid of webbing slots 122, a plurality of rigid stay protrusion slots 124 and a plurality of mounting hardware holes 126. A corner bracket 130 can attach the wide luggage carrier mounting panel 120 to the luggage carrier 128. A tool clip 132 can be attached to the plurality of mounting hardware holes 126.

There are many ways using known materials and known material working techniques in order to build this system. For instance, cutting sheets of plastic or plastic injection molding could be used. In some embodiments the protrusion can be made with a rivet.

As used in this application a "mountable surface" is any of a "saddlebag" a "luggage carrier" or a "wall" or any other place where the system can be conveniently mounted.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A storage system, is configured to store material on a mountable surface, the storage system comprises:

a mounting panel, further comprising a pouch attachment ladder system grid of webbing slots, a plurality of rigid stay protrusion slots and a plurality of mounting hardware holes;

a modular lightweight load-carrying equipment holster further comprising a pouch attachment ladder system grid of webbing;

wherein the pouch attachment ladder system grid of webbing fits through the pouch attachment ladder system grid of webbing slots which is then held in place with a rigid stay;

wherein the rigid stay further comprises a protrusion in order to prevent the rigid stay from sliding out of the pouch attachment ladder system grid of webbing.

2. The storage system of claim 1, wherein the storage system further comprises:

a rear mounting screw, inserted through a drilled mountable surface mounting hole in the mountable surface.

3. The storage system of claim 2, further comprising:

a coupling nut, joined to the rear mounting screw;

wherein the coupling nut is connected to a mounting hardware hole with a short front mounting screw, a washer and a trim washer.

4. The storage system of claim 2, further comprising a spacer sleeve, joined to the rear mounting screw;

a long front mounting screw joined to the spacer sleeve through a mounting hardware hole with a washer and a trim washer.

* * * * *